US005814931A

United States Patent [19]

Makishima

[11] Patent Number: 5,814,931

[45] **Date of Patent: *Sep. 29, 1998**

[54] COLD CATHODE AND CATHODE RAY TUBE USING THE COLD CATHODE

[75] Inventor: Hideo Makishima, Tokyo, Japan

[73] Assignee: NEC Corporation, Tokyo, Japan

[ * ] Notice: The term of this patent shall not extend beyond the expiration date of Pat. No. 5,604,401.

[21] Appl. No.: 734,695

[22] Filed: Oct. 21, 1996

[30] Foreign Application Priority Data

Oct. 23, 1995 [JP] Japan ..... 7-273800

[51] Int. Cl.[6] ..... H01J 1/46

[52] U.S. Cl. ..... 313/441; 313/309; 313/351; 313/336

[58] Field of Search ..... 313/309, 336, 313/351, 441, 311

[56] References Cited

U.S. PATENT DOCUMENTS

| | | | |
|---|---|---|---|
| 5,496,199 | 3/1996 | Makishima et al. | 445/24 |
| 5,514,847 | 5/1996 | Makishma et al. | 313/309 |
| 5,604,401 | 2/1997 | Makishma et al. | 313/309 |

FOREIGN PATENT DOCUMENTS

| | | |
|---|---|---|
| 63-76240 | 4/1988 | Japan . |
| 6-139918 | 5/1994 | Japan . |
| 7-147129 | 6/1995 | Japan . |

OTHER PUBLICATIONS

Yokoo et al., "Technological Breakthrough in Development of Field Emitter Display", *Proceedings of the First International Display Workshops '94*, pp. 19–22.

Kesling et al., "Field–Emission Display Resolution", *SID 93 Digest*, pp. 599–602.

Spindt et al., "A Thin–Film Field–Emission Cathode", *Journal of Applied Physics*, vol. 39, No. 7, Jun. 1968, pp. 3504–3505.

*Primary Examiner*—Sandra L. O'Shea
*Assistant Examiner*—Joseph Williams
*Attorney, Agent, or Firm*—Young & Thompson

[57] ABSTRACT

The invention forms on a substrate an electron emission area composed of at least a single micro cold cathode which is composed of an emitter and a gate electrode, arranges plural focusing electrodes surrounding this electron emission area in the periphery of the electron emission area, and connects with each other the focusing electrodes facing each other around the electron emission area. An electron beam having a vertically long spot near the cathode is formed by making more intense the horizontal focusing when the electron beam is scanning the peripheral part of the screen on the basis of a horizontal and a vertical synchronizing signal. Thus the invention can correct distortion of the electron beam caused by deflection and can achieve and excellent resolution all over the display screen, and furthermore, can compose a cathode ray tube using this cold cathode as an electron source.

5 Claims, 9 Drawing Sheets

COLD CATHODE AND CATHODE RAY TUBE USING THE COLD CATHODE

BACKGROUND OF THE INVENTION

1. Field of the Invention

The present invention relates to a microstructure cold cathode that is fabricated by using thin film technology and the like, and to an electron beam device employing the cold cathode, and particularly to a cathode ray tube used in a color television set or a display apparatus.

2. Prior Art

A field emission cold cathode was proposed by C. A. Spindt et.al. (Journal of Applied Physics, Vol.39, No.7, pp. 3504, 1968). FIG. 9A shows the structure of this field emission cold cathode, and each of FIG. 9B and FIG. 9C shows a sectional view of one of micro cold cathodes 107 forming such a cold cathode. An insulating layer 102 of silicon oxide and a control electrode 103 is formed on the silicon substrate 101. A hollow 109 is formed by removing part of the insulating layer 102 and part of the control electrode 103, and an emitter 104 having a sharp tip is formed on the substrate 101 inside the hollow 109. A micro cold cathode 107 is formed of the emitter 104, the control electrode 103, and the hollow 109 formed in the control electrode 103 and the insulating layer 102, and a plane-shaped cold cathode 108 having an electron emission area is formed by arranging the micro cold cathodes 107 in an array.

The substrate 101 and the emitter 104 are electrically connected with each other, and a voltage of about 50 volts is applied between the emitter 104 and the gate electrode 103. The insulating layer 102 is about 1 μm in thickness and an opening of the control electrode 103 also is as small as about 1 μm in diameter, and since the tip of the emitter 104 is made as very sharp as about 10 nm in radius, a strong electric field is applied to the tip of the emitter 104. In case that this electric field reaches 2 to $5\times10^7$ volts/cm or greater, electrons are emitted from the tip of the emitter 104. A plane-shaped cathode for emitting a great current is composed by arranging micro cold cathodes of such structure in array on the substrate 101. Furthermore, by increasing the density of the micro cold cathodes by means of a micro processing technology, a cathode current density can be increased 5 to 10 times or more than by using an existing hot cathode.

The Spindt type cold cathode has advantages that it is higher in cathode current density and is smaller in variance of speeds of the emitter electrons in comparison with a hot cathode. And in comparison with a single field emission emitter, it has less current noise, works at a low voltage of about 10 to 100 volts, and works even in a comparatively poor vacuum environment.

However, an electron beam emitted from the tip of the emitter 104 is spread by an electric field formed near the tip of the emitter, and an electron emitted from the periphery of the emitter has a radial component of speed. In order to suppress the horizontal component of speed, trajectories of the electrons emitted from the emitter 104 are converged by forming a focusing electrode 106 on the control electrode with an insulating layer 105 between them as shown in FIG. 9C (SID '93 Digest, pp. 599 to 602, 1993) or by forming a ring-shaped focusing electrode 111 around the control electrode 103 as shown in FIG. 10 (Proceedings of the First International Display Workshops, pp. 19 to 22, 1994).

When using this cold cathode in a cathode ray tube (hereinafter referred to as a CRT), since it needs no heating power and is high in cathode current density, there is a possibility that a display device of low power consumption and high resolution can be attained. Furthermore, in an electron beam device such as a microwave tube other than a CRT, there is a possibility that a device of high performance can be implemented by utilizing features of a cold cathode.

A color CRT provided with an inline type electron gun in which three cathodes are arranged in the same plane in the horizontal direction is used in a color television set or a color display apparatus. In such a CRT, a self-convergence system is adopted which converges three electron beams on an arbitrary point on the screen by combining a horizontal deflection magnetic field having a pincushion distortion and a vertical deflection magnetic field having a barrel distortion.

However, when an electron beam passes through the self-convergence magnetic field, a beam spot which is circular in the middle of the screen is flattened in the horizontal direction under the influence of distortion of the magnetic field in the peripheral part of the screen. As the result, resolution in the peripheral part of the screen, particularly the resolution in the horizontal direction is deteriorated.

In order to solve this problem, a quadrupole lens has been used in some CRTs up to now. In a Japanese Unexamined Patent Publication (Koukai) No. 63-76240, a structure using a quadrupole lens between focusing electrodes in the electron gun part of a CRT has been disclosed as shown in FIG. 11. In FIG. 11, three Cathodes 121 are disposed at specified intervals in in-line shape. A control electrode 122, an accelerating electrode 123, a focusing electrode 136 and anode 126 are arranged along the axis of a electron becam. The focusing electrode 136 is composed of two electrodes, a front side electrode 124 and a rear side electrode 125 which are disposed before and behind each other along the axis of the electron beam. Each of the front side electrode 124 and the rear side electrode 125 has a vertically long opening formed in the position of the axis of the electron beam. Quadrupole electrodes 127 are disposed between the front side electrode 124 and the rear side electrode 125, and the front side electrode 124 and the rear side electrode 125 are kept at the same electric potential by a connecting wire 128.

The quadrupole electrode 127 is composed of four electrode pieces 129 and 130 for one electron beam axis. An electron beam is put vertically between a pair of electrode pieces 129 and horizontally between a pair of electrode pieces 130. An electron beam's aberration which makes the electron beam's section horizontally long is compensated in advance by applying a force which diverges the electron beam in the vertical direction and converges it in the horizontal direction to the electron beam by applying voltages to the two pairs of electrode pieces 129 and 130 which vary according to the spot's position on the screen. As the result, distortion of the electron beam in the peripheral part of the screen is reduced and a uniform focusing characteristic can be achieved on the whole screen.

In a Japanese Unexamined Patent Publication (Kokai) No. 7-147129, as shown in FIG. 12, a technique has been disclosed which compensates distortion of an electron beam by dividing the electron emission area of a field emission type cathode and controlling its electron emission according to position of the electron beam's spot on the screen. Namely, when the electron beam's spot is in the middle of the screen where it is not distorted, the electron beam is taken out from a main emitter area circular in shape 131*a*.

When the electron beam's spot is in the peripheral part of the screen, the electron beam is taken out from three areas of the main emitter area 131*a* and sub-emitter areas 131*b* and 131*c*, and a pattern of the emitted electron beam is set vertically long in shape. As the result, since the spot is made circular in the peripheral part of the screen by being distorted, the spot is formed circular on the whole screen.

Throughout this specification, it is assumed that when the cathode is mounted in a CRT a direction in which the spot is formed in the vertical direction of the display screen is the vertical direction of the cathode and a direction in which the spot is formed in the horizontal direction of the display screen is the horizontal direction of the cathode.

A method of compensating distortion of an electron beam by means of a quadrupole lens, like a CRT electron gun shown in FIG. 11, has a problem that its electron gun is complicated in structure and is made more expensive by increasing the number of components due to necessity of forming an unsymmetrical lens by adding to the electron gun a grid electrode provided with a vertically long hole and a horizontally wide hole for passing an electron beam.

A method of using a divided cathode shown in FIG. 12 has a problem that although the electron beam spot is circular on the whole screen, a uniform resolution cannot be obtained due to difference in size between the electron beam spot in the middle of the screen and that in the peripheral part of it.

SUMMARY OF THE INVENTION

An object of the invention is to provide a cold cathode which is simple in structure, inexpensive in cost, and uniform and high in resolution, and to a cathode ray tube using such a cold cathode.

An embodiment of the present invention forms on a substrate an electron emission area composed of a number of micro cold cathodes each of which is composed of an emitter and a gate electrode, arranges a focusing electrode divided into at least four parts on the circumference around this electron emission area, and connects with each other the upper and the lower focusing electrode as a pair and connects with each other the right and the left focusing electrode as a pair.

According to an electron beam deflected position, a focusing voltage is applied to the focusing electrode so as to make more intense the horizontal focusing than the vertical focusing when scanning the peripheral part of the display screen, and the focusing voltage is applied to it so as to make the horizontal and the vertical convergence almost equal to each other when scannung the middle of the display screen.

Another embodiment of the invention forms on a substrate an electron emission area composed of a number of micro cold cathodes each of which is composed of an emitter and a gate electrode, forms a ring-shaped auxiliary electrode around the electron emission area, arranges a focusing electrode divided into at least four parts on the circumference outside this auxiliary electrode, and connects with each other the upper and the lower focusing electrode as a pair (in the vertical direction) and connects with each other the right and the left focusing electrode as a pair (in the horizontal direction).

A focusing voltage similar to the first embodiment is applied to the vertical and the horizontal focusing electrode.

An additional embodiment of the invention divides a circular electron emission area into at least three parts along the vertical direction, and controls an amount of emitted electrons so as to make the total emission current uniform on the whole display screen by emitting electrons from the whole electron emission area when scanning the middle of the display screen and emitting electrons from the central electron emission area when scanning the peripheral part of the display screen.

As the result, since deflection distortion accompanying deflection of an electron beam is compensated in an inline-type electron gun, a uniform and high resolution can be achieved all over the display screen. Furthermore, since an electrode for compensation is formed on a substrate, this method dispenses with an electrode complicated in shape like a quadrupole lens, and does not increase the number of components of the electron gun and does not need a time for assembly and adjustment.

DESCRIPTION OF THE PREFERRED EMBODIMENTS

Figure 1A:
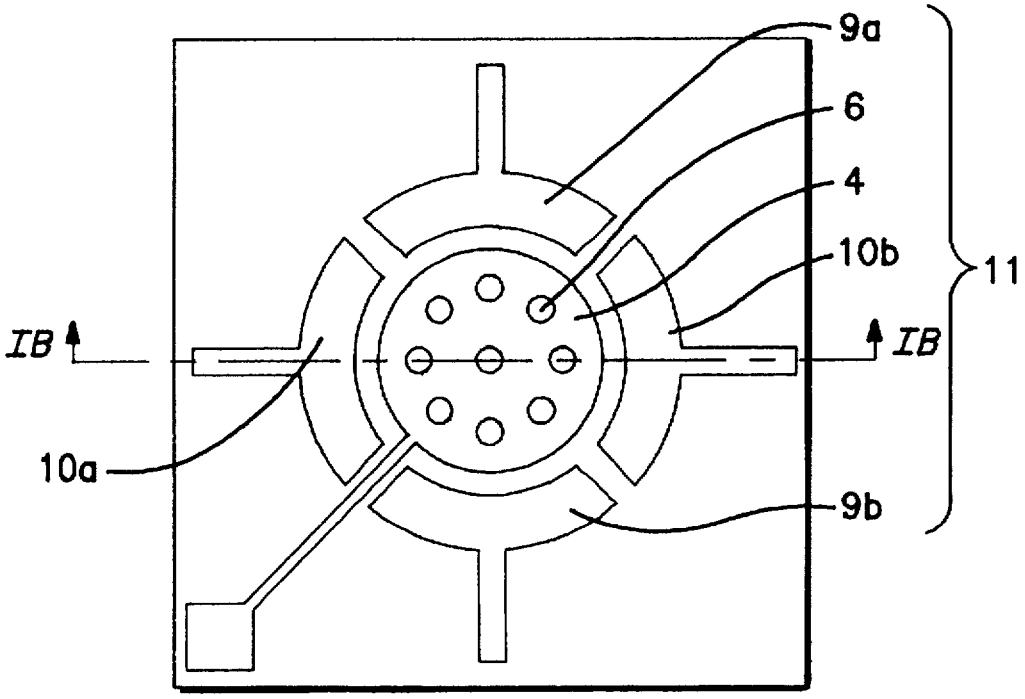
FIG. 1A shows a plan view of a cold cathode according to a first embodiment of the invention.
Figure 1B:
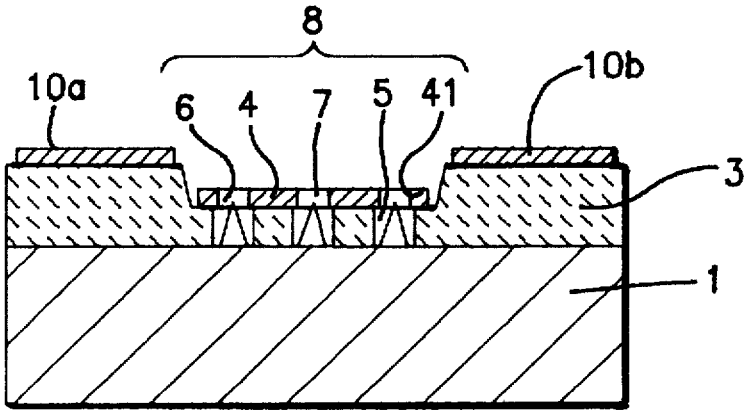
FIG. 1B shows a sectional view of FIG. 1A taken along a line IB—IB.

Referring to FIG. 1A and FIG. 1B, an insulating layer 3 is formed on a substrate 1 and then a gate electrode 4 is formed on the insulating layer 3, and a plurality of micro openings 41 and hollows 5 are formed in the gate electrode 4 and the insulating layer 3, respectively. Each conical emitter 6 for emitting electrons is formed inside of each hollow 5 and the emitter 6 is electrically connected with the substrate 1. Each micro cold cathode 7 is composed of the emitter 6, an opening 41 of the gate electrode 4 and the hollow 5, and a number of micro cold electrodes form an electron emission area 8. Focusing electrodes 9*a*, 9*b*, 10*a* and 10*b* which are obtained by dividing a focusing electrode into four parts are arranged so as to surround the gate electrode 4. Vertical focusing electrodes 9*a* and 9*b* are opposite to each other with the electron emission area 8 between them and are connected with each other outside the cold cathode 11 so that the same voltage may be applied to them. In the same way, horizontal focusing electrodes 10*a* and 10*b* are opposite to each other with the electron emission area 8 between them and are connected with each other outside the cold cathode 11 so that the same voltage may be applied to them. The cold cathode is composed of the components from the substrate 1 to the horizontal focusing electrodes 10.

Figure 11:
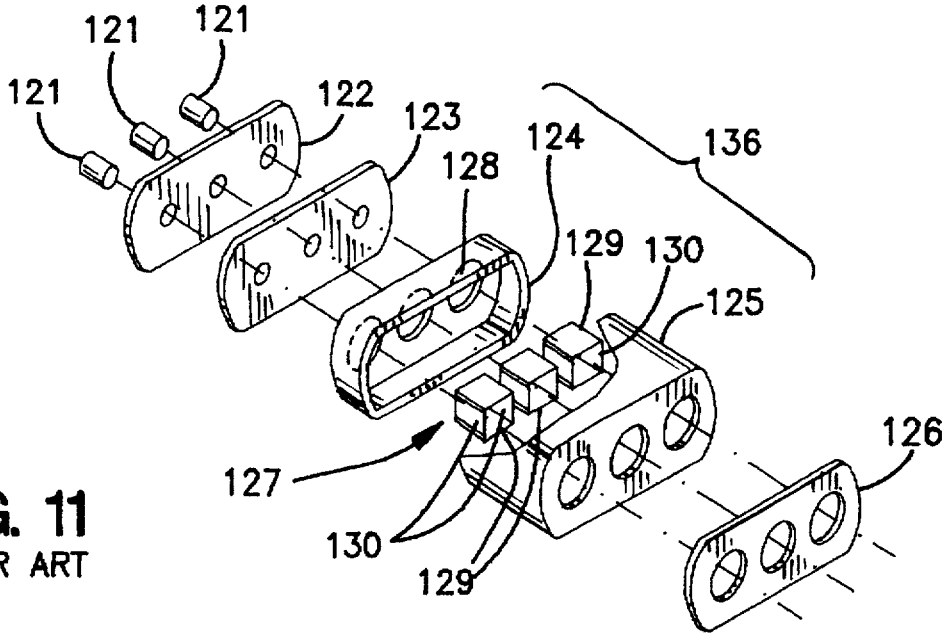
FIG. 11 PRIOR ART
FIG. 11 shows a perspective view of an electrode structure of a CRT electron gun of the prior art disclosed in a Japanese Unexamined Patent Publication (Kokai) No. 63-76240.

In FIG. 1A and FIG. 1B, since width of the horizontal focusing electrode and width of vertical focusing electrode have an influence upon a focusing voltage sensitivity and the focusing electrodes wider in width have a comparatively greater influence upon an electron beam, the wider electrodes can control the electron beam with a smaller voltage variation. And in this embodiment, since a focusing voltage is applied to the electron beam at a lower electron beam speed in comparison with an existing electron gun shown in FIG. 11, it is possible to easily obtain a focusing effect with an electric field generated by an electrode formed in the plan shape where the focusing electrode is several 100 μm in width.

An insulating layer 3 is thicker in the peripheral part, namely, the area where the focusing electrodes 9*a*, 9*b*, 10*a* and 10*b* are formed to the edges of the cold cathode 11, than in the middle electron emission area. This has such effects that (i) since thickness of the insulating layer 3 in an area other than the electron emission area 8 has no influence upon an electron emission characteristic, a load on the driving circuit is reduced by suppressing an increase of the electrostatic capacity through increasing the thickness of the insulating layer 3, (ii) an insulation resistance is improved by securing a distance between the gate electrode 4 and the focusing electrodes, and (iii) the focusing electrodes are improved in controllability by increasing an influence which the electric potentials of the focusing electrodes have upon a trajectory of an electron beam, and other effects.

The emitter 6 is made of refractory metal like tungsten or molybdenum, the gate electrode 4 is made of metal or metal alloy such as tungsten, molybdenum, niobium, and tungsten silicide, and a single layer or a multilayer of silicon oxide or silicon nitride is used for the insulating layer 3. Each opening 41 of the gate electrode 4 is about 1 μm in diameter, the emitter is about 1 μm in height, the insulating layer 3 in the electron emission area 8 is about 0.8 μm in thickness, the insulating layer 3 in the other area than the electron emission area 8 is about 2 μm in thickness, and the gate electrode 4 is about 0.2 μm in thickness.

As disclosed in a bibliography (Journal of Applied Physics, Vol.39, No.7, pp.3504, 1968) and the like, fundamentally, this cathode can be made by a process that after the openings 41 and the hollows 5 are formed in the gate electrode 4 and the insulating layer 3, respectively, a sacrifice layer is deposited from an inclined direction as tuning the wafer, and then an emitter material is deposited from right above the wafer.

Figure 2A:
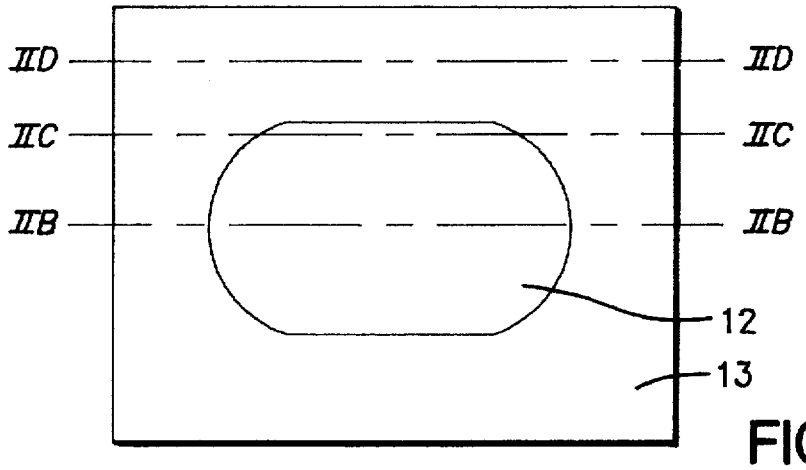
FIG. 2A shows the display screen of a CRT containing the cold cathode according to the first embodiment of the invention.
Figure 2B:
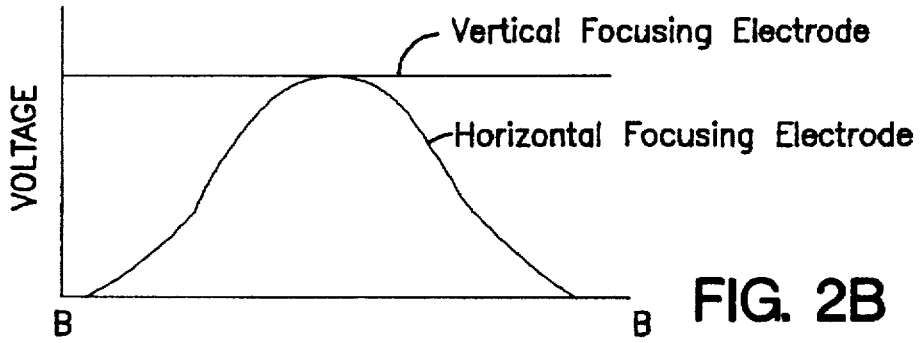
FIG. 2B to FIG. 2D show the focusing electrode voltages in a horizontal scanning period on various parts of the screen shown in FIG. 2A taken along lines IIB—IIB, IIC—IIC and IID—IID, respectively.
Figure 2C:
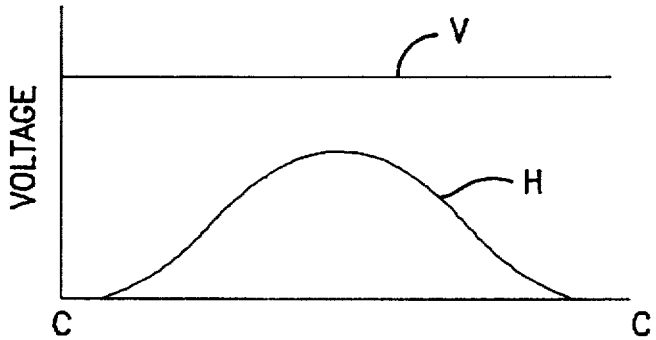
Figure 2D:
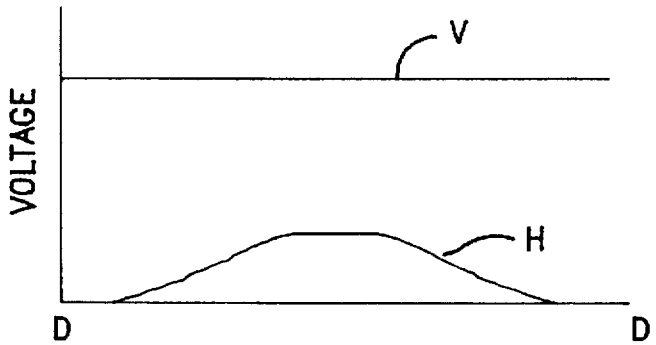

As is shown in FIG. 2A and FIG. 2D, the same and constant voltage is always applied to the vertical focusing electrodes 9*a* and 9*b* while the varying voltage which varies according to a horizontal scanning position in a horizontal scanning period is applied to the horizontal focusing electrodes 10*a* and 10*b* so that the horizontal focusing lens may be made more intense in lens power in the peripheral part of the screen than in the middle of the screen.

Figure 3A:
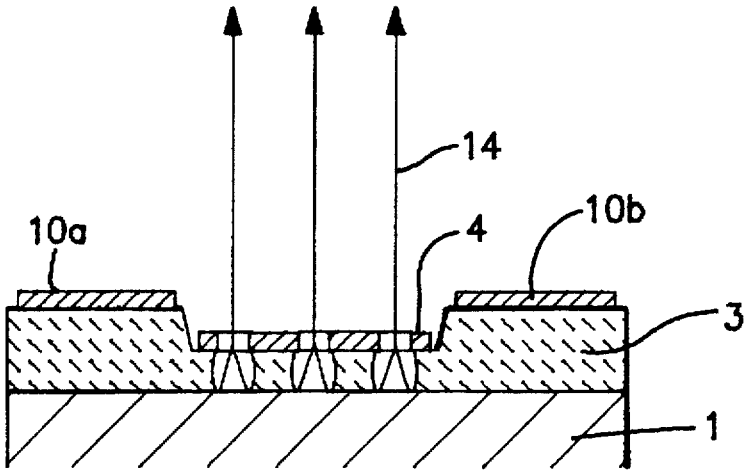
FIG. 3A is a sectional view showing trajectories of electrons emitted from electron guns when the electron beams are deflected to the central part of the screen.
Figure 3B:
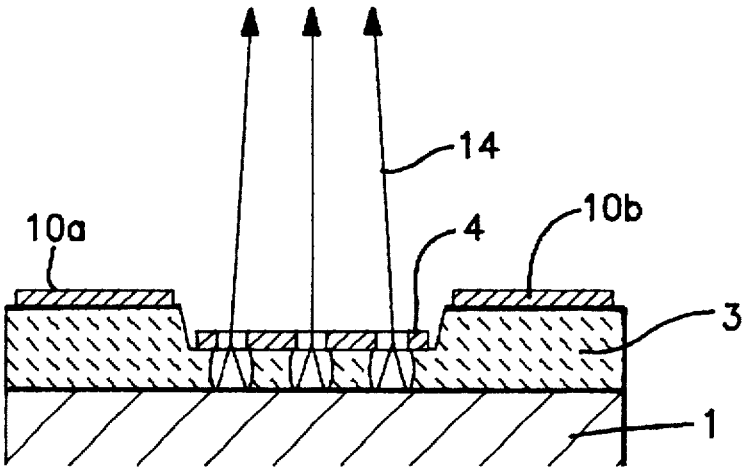
FIG. 3B is a sectional view showing trajectories of electron emitted from electron guns when the electron beam are deflected to the peripheral part of the screen.

As is shown in FIG. 3A, in any of the horizontal and the vertical section in the middle of the screen, the electron beams 14 emitted from the emitter 6 are emitted perpendicularly to the cold cathode 11 according to a potential distribution formed by the emitter 6, the gate electrode 4, the focusing electrodes 9*a*, 9*b*, 10*a* and 10*b*, and an external electron gun (not shown). In the peripheral part of the screen, the electron beam 14 in the vertical section are emitted perpendicularly to the cold cathode 11, but the electron beams 14 in the horizontal section are moved away from the cold cathode 11 along trajectories so as to converge on the middle of the screen as shown in FIG. 3B. This is because when scanning the peripheral part the voltage applied to the horizontal focusing electrodes 10*a* and 10*b* becomes lower than when scanning the central part to move electron beams toward the central part.

In this manner, the same focusing is performed in the horizontal and the vertical direction in the central part of the screen inside the solid line shown on the display screen of FIG. 2A, while the focusing is more intensely performed in the horizontal direction in the peripheral part 13 of the screen.

A structure of an electron emitting device provided with four deflection electrodes through an insulating film on focusing electrodes has been disclosed in a Japanese Unexamined Patent Publication (Kokai) No. 6-139918. In this case, four deflection electrode pieces are formed around an opening surrounding each of individual emitters. These deflection electrodes have a function for changing a direction of an electron beam emitted from an emitter, and to do so, they are composed so that different voltages may be applied to independent electrode pieces facing each other with the opening between them.

However, this prior art does not show to control the electron beams so that the sectional shape of the electron beams may be unsymmetrical in relation to the central axis as disclosed in the invention.

Figure 4A:
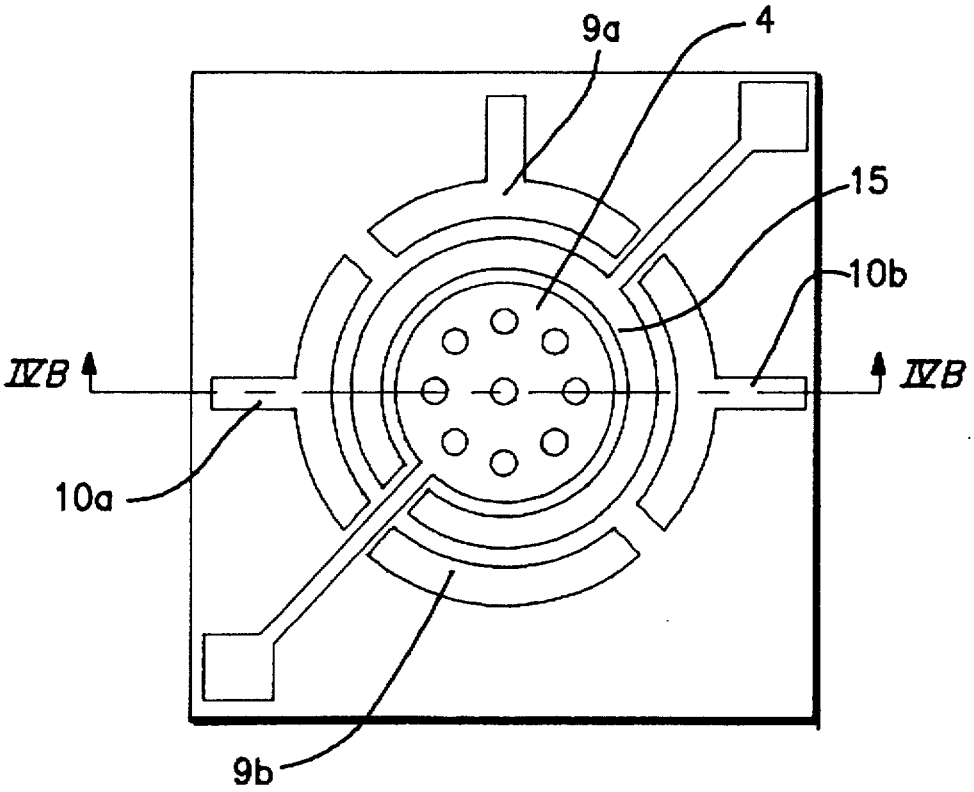
FIG. 4A shows a plan view of a cold cathode of a second embodiment of the invention.
Figure 4B:
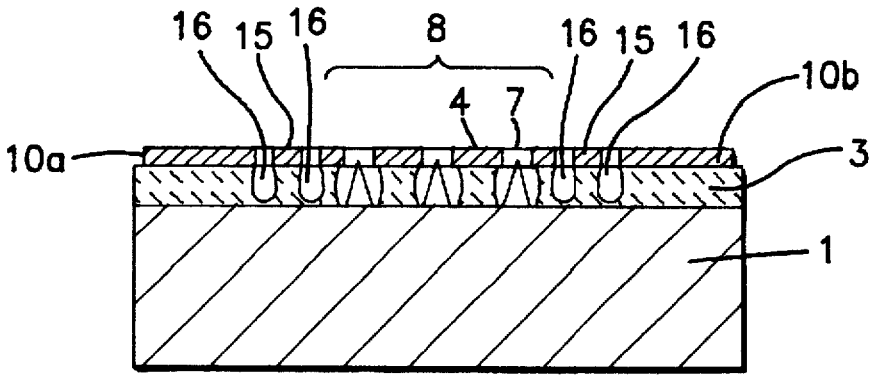
FIG. 4B shows a sectional view of FIG. 4A taken along a line IVB—IVB.

The second embodiment shown in FIGS. 4A and 4B is different from the first embodiment shown in FIG. 1 in that (1) a focusing electrode 15 is formed between the gate electrode 4 and the horizontal focusing electrode 10 and between the gate electrode 4 and the vertical focusing electrode 9, and (2) the insulating layer 3 is equal in thickness between the substrate 1 and the gate electrode 4, the horizontal focusing electrode 10, the vertical focusing electrode 9 and the focusing electrode 15, and grooves 16 are formed in the surface of the insulating layer 3 between the respective electrodes.

The focusing electrode 15 is an electrode for adjusting trajectories of the electron beams, namely, the focusing conditions of the electron beams emitted from the electron emission area 8 composed of plural micro cold cathodes 7, and improves the adjustment better in freedom in comparison with the first embodiment shown in FIGS. 1A and 1B.

The grooves 16 between the electrodes are intended for expanding a distance along the surface of the insulating layer 3 between the electrodes and this expansion has improved dielectric strength between the electrodes.

Figure 10:
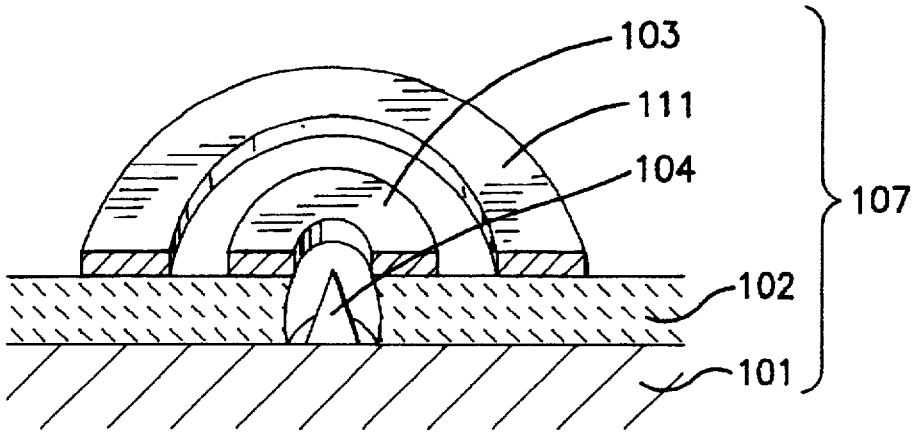
FIG. 10 PRIOR ART
FIG. 10 shows a perspective view of a micro cold electrode having a focusing electrode of the prior art.

Since the stepped structure of the insulating layer of the first embodiment and the grooves in the insulating layer of the second embodiment have no relation to the surface electrode structures of the respective embodiments, they can be also applied to the insulating layer between a focusing electrode and a gate electrode which are formed around a single emitter, for example as shown in FIG. 10, as well as can be applied to any of the embodiments.

The waveform of voltage applied to the horizontal focusing electrode 10 and the vertical focusing electrode 9 and the sectional shape of the electron beams are the same as the first embodiment.

Figure 5:
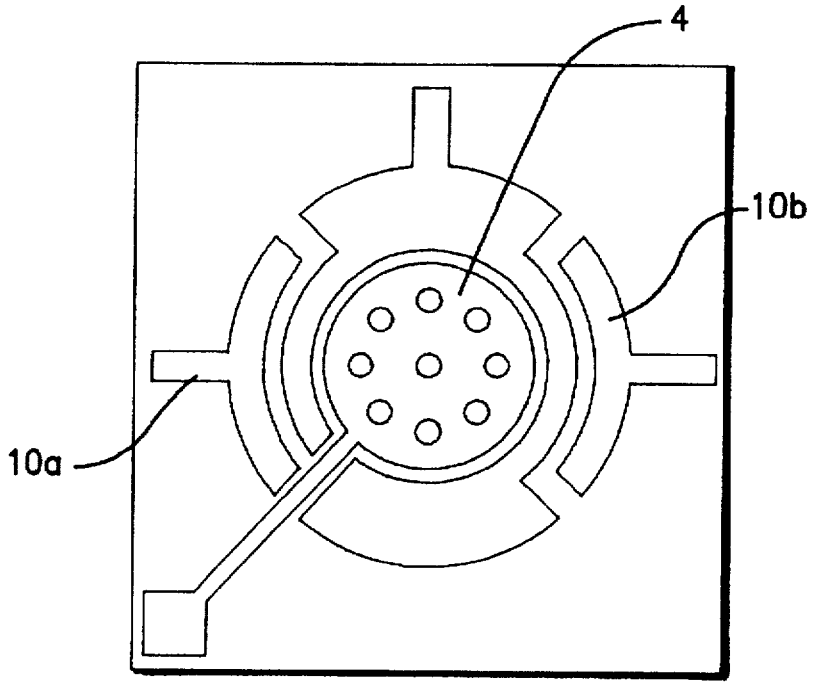
FIG. 5 is a plan view of a cold cathod of a third embodiment of the invention.

In the third embodiment shown in FIG. 5, the focusing electrode 15 and the vertical focusing electrodes 9*a* and 9*b* of the second embodiment shown in FIG. 4A are combined having a vertical focusing electrode 9 as an electrode pattern common to them. The third embodiment can achieve a focusing function by almost the same potential distribution as the second embodiment and can reduce the number of lead wires to be drawn out to the outside. This embodiment makes the horizontal focusing electrode 10 and the vertical focusing electrode 9 nearly equal to each other in voltage to be applied to them in the middle of the screen and makes more intense the horizontal focusing by lowering voltage applied to the horizontal focusing electrode 10 in the peripheral part of the screen.

The waveform of the voltage and trajectories of the electron beams on various parts of the screen are almost equal to those in FIGS. 2 and 3.

Figure 6:
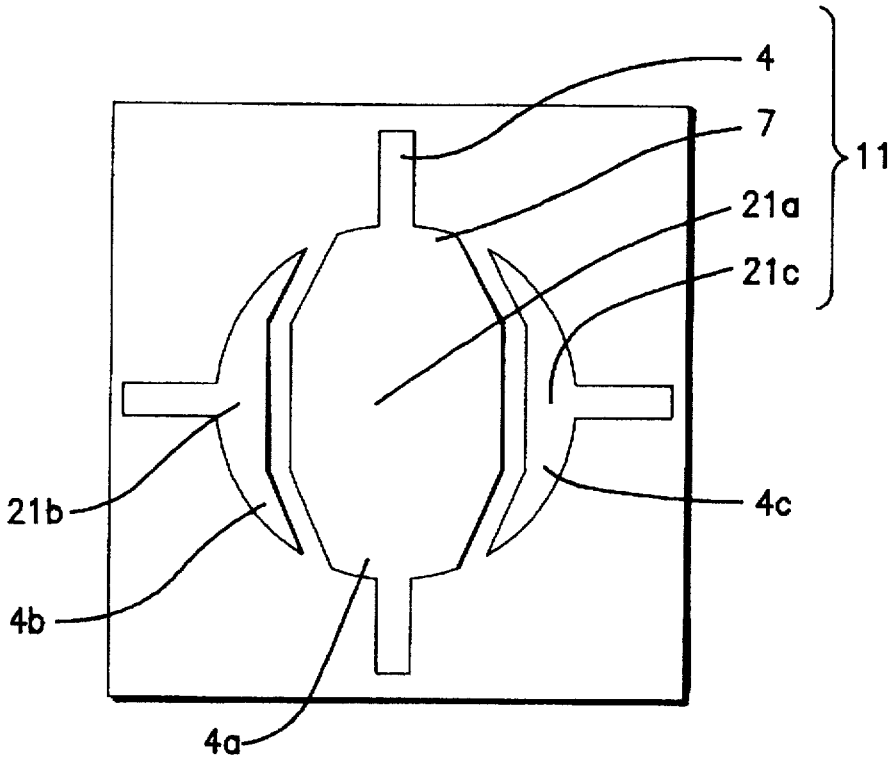
FIG. 6 is a plan view of a cold cathode of a fourth embodiment of the invention.

In a fourth embodiment of the invention shown in FIG. 6, a circular electron emission area is divided into three parts of a main electron emission area 21*a* and auxiliary electron emission areas 21*b* and 21*c* at both sides of it by dividing the gate electrode 4 into three parts.

Figure 7A:
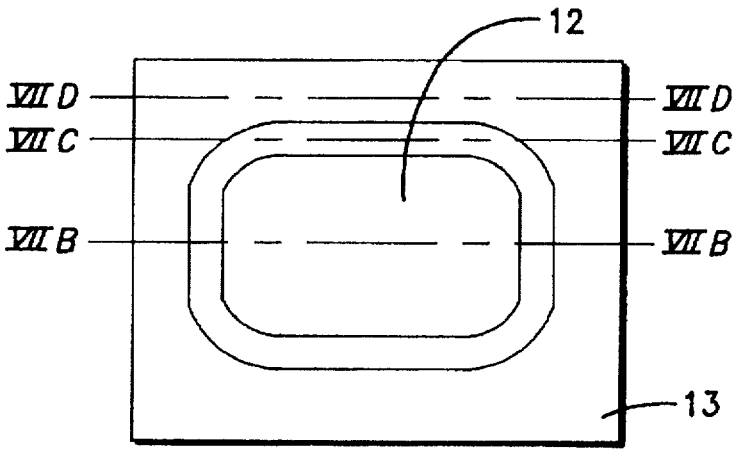
FIG. 7A shows the display screen of a CRT containing the cold cathode according to the fourth embodiment of the invention.

When the central part 12 of the screen is scanned, electrons emitted from the main electron emission area 21*a* and those emitted from the auxiliary electron emission areas 21*b* and 21*c* are nearly equal to one another in current density as shown in FIG. 7A (cathode current density). When the peripheral part 13 of the screen is scanned, electrons emitted from the auxiliary electron emission areas 21*b* and 21*c* are almost zero in current density, while electrons emitted from the main electron emission area 21*a* are increased and the total electric current emitted from the cathode is kept almost constant all the scanning period round, and there is no variation of brightness on the screen in a horizontal scanning period as shown in FIG. 7D. In a transient area between the central part 12 and the peripheral part 13 of the screen, the electric current emitted from the auxiliary electron emission areas 21*b* and 21*c* is decreased gradually and the electric current emitted from the main electron emission area 21*a* is increased gradually as moving from the central part to the peripheral part so that the total current may be kept almost constant as shown in FIG. 7C.

Figure 7B:
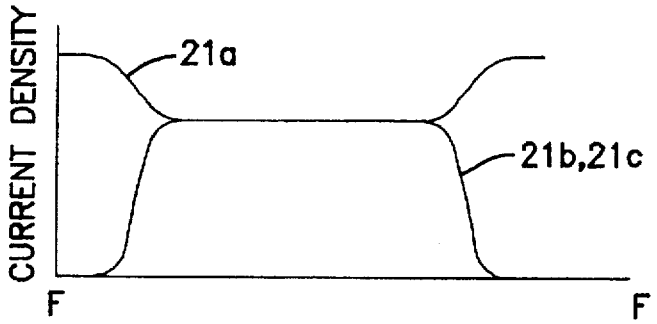
FIG. 7B to FIG. 7D show the cathode current densities in a horizontal scanning period on various parts of the screen shown in FIG. 7A taken along lines VIIB—VIIB, VIIC—VIIC and VIID—VIID, respectively.
Figure 7C:
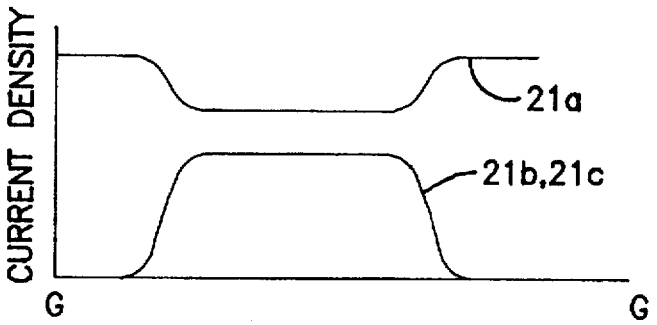
Figure 7D:
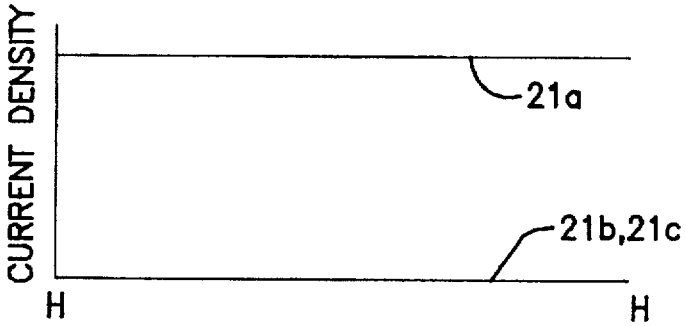

In order to change the current density of the cathode emission current as shown in FIGS. 7B to 7D, it will do to change the gate electrode voltage on the basis of the horizontal and the vertical synchronizing signal. Since there is not a direct relation but a unique relation between the gate electrode voltage and the cathode current density, an approximate gate electrode control voltage waveform is nearly equal to the current density waveform in FIGS. 7B to 7D.

Although the fourth embodiment shows an example of dividing the gate electrode 4 to control it, the same effect can be obtained also by dividing the emitter electrode (cathode).

Figure 8:
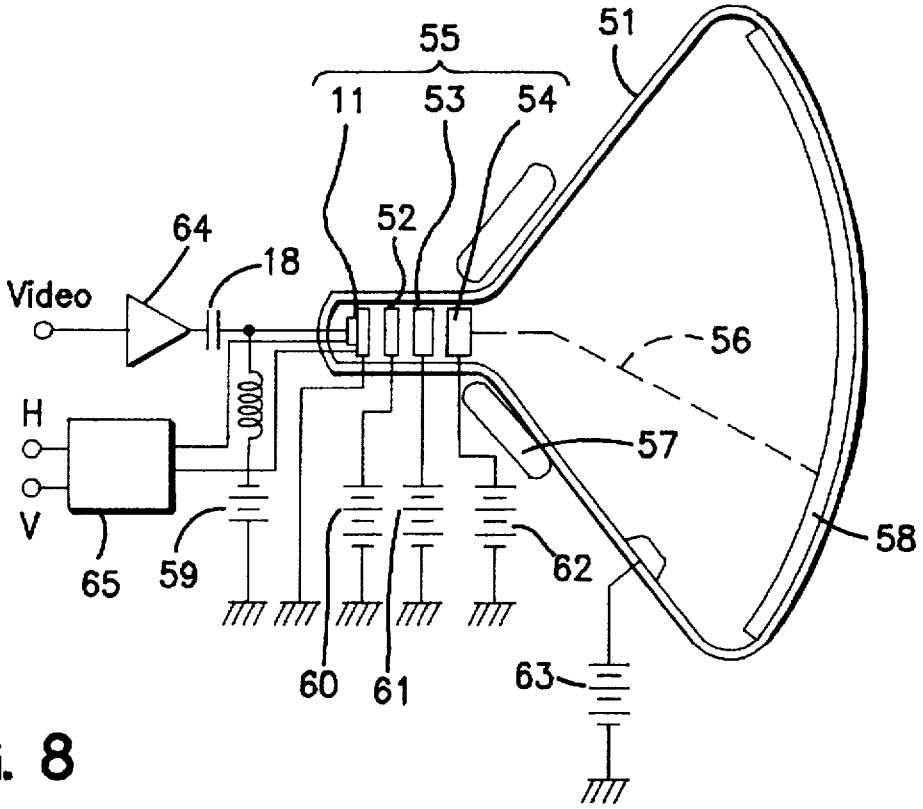
FIG. 8 shows structure of a CRT of a fifth embodiment of the invention.
Figure 12:
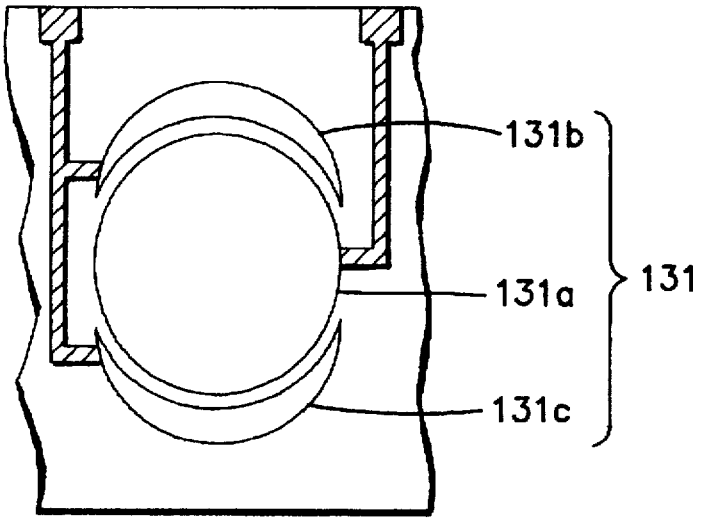
FIG. 12 PRIOR ART
FIG. 12 is a plan view of a cold cathode of the prior art disclosed in a Japanese Unexamined Patent Publication (Kokai) No. 7-147129.
Figure 9A:
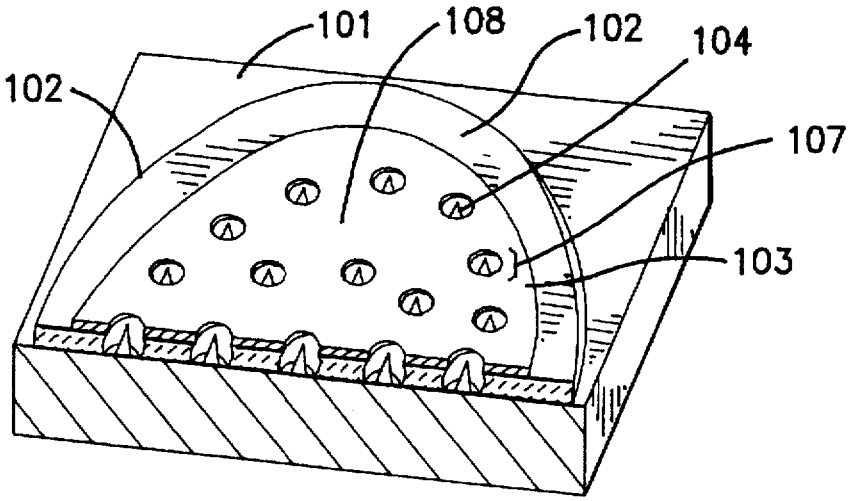
FIG. 9A PRIOR ART
FIG. 9A shows a perspective view of a Spindt type cold cathode of the prior art.
Figure 9B:
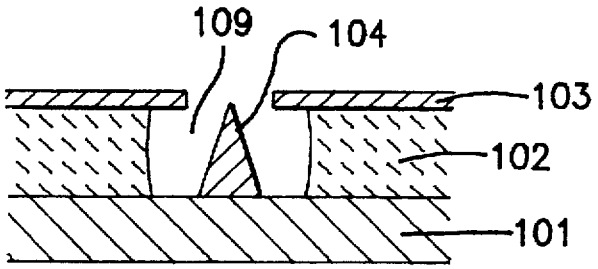
FIG. 9B PRIOR ART
FIG. 9B and FIG. 9C show sectional views of a part of micro cold cathodes according to the prior art.
Figure 9C:
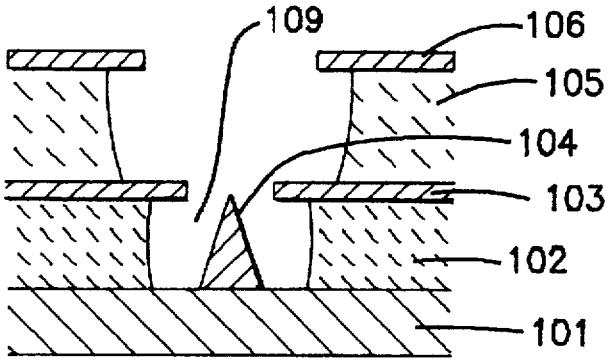
FIG. 9C PRIOR ART

FIG. 8 shows a sectional view of a CRT as an electron beam device using three cold cathodes 11 as electron sources in a fifth embodiment of the invention. An electron gun 55 composed of cold electrodes 11, a first focusing electrode 52, a second focusing electrode 53, and a third focusing electrode 54 is accommodated in a glass envelope 51. Reference numerals 59 to 63 are direct current constant-voltage power sources, which supply current and voltage to the substrate 1, the first focusing electrode 52, the second focusing electrode 53, the third focusing electrode 54, and the anode, respectively. Signals such as a video signal for modulating an electron beam current and the like are applied to the substrate 1 through an amplifier 64 to a coupling capacitor 18.

A horizontal synchronizing signal (H) and a vertical synchronizing signal (V) are applied to a control circuit 65 to form a signal for controlling a horizontal focusing electrodes 10*a* and 10*b* (FIGS. 1, 4 and 5) or gate electrodes 4*a*, 4*b* and 4*c* of the main electron emission area 21*a*, auxiliary electron emission areas 21*b* and 21*c* (FIG. 6). Electrons emitted from the cold cathode 11 are focused and accelerated to form an electron beam 56. The electron beam 56 is deflected according to a current waveform applied to deflection yoke 57 and strikes against a fluorescent material 58.

An ordinary CRT forms a crossover of electron beams immediately in front of the cathode and forms an image by projecting the crossover image onto the fluorescent material 58 by means of an electron lens composed of the first to third focusing electrodes 52, 53 and 54. In order to more clearly reflect an effect of the invention, it is preferable to use an electronic optical system which forms the image by projecting an image on or near the cathode onto the fluorescent material 58.

The CRT shown in the embodiment has such advantages that it has a high resolution, a number of pixels which can be displayed on the screen, an excellent stability, and a small power consumption.

The number of divided focusing electrodes and the number of divided electron emission areas are not limited to the number shown in the embodiments, but the similar effect can be attained also by increasing the number of divided electrodes or electron emission areas.

The above-mentioned embodiments have shown a Spindt type structure in which an emitter is formed on a conductive substrate, but without limiting to this, it is apparent that the invention can be also applied to a field emission cold cathode in which an emitter is formed by means of an etching method or a field emission cold cathode in which an electrode is formed on an insulating substrate and then an emitter is formed on the electrode.

Furthermore, it is evident that a similar effect can be obtained by applying the invention not only to a field emission cold cathode but also to a cold cathode of junction type, MIN (MOS) type, or thin film type.

As described above, since the invention compensates distortion of an electron beam spot caused by deflection of the electron beam emitted from an in-line electron gun, a uniform and high resolution can be achieved all over the display screen by means of a simple electron gun structure.

What is claimed is:

1. A cold cathode comprising a substrate, a plurality of electron emission electrodes formed on said substrate, an insulating layer formed on said substrate except on said electron emission electrodes and their vicinity, a gate electrode formed on said insulating layer and having openings surrounding respective said electron emission electrodes, and a focusing electrode surrounding said gate electrode, said focusing electrode being divided into at least four parts such that a pair of said focusing electrodes parts are facing each other with said gate electrode between them so as to be controlled at the same time.

2. A cold cathode according to claim 1, wherein at least one of a portion of said insulating layer between said gate electrode and said focusing electrode and a portion of said insulating layer between a first pair of said focusing electrode parts and a second pair of said focusing electrode parts comprises a raised peripheral portion.

3. A cold cathode according to claim 1, wherein at least one of a portion of said insulating layer between said gate electrode and said focusing electrode and a portion of said insulating layer between said focusing electrode parts comprises a groove.

4. A cold cathode comprising: a substrate, a plurality of electron emission electrodes formed on said substrate, an insulating layer formed on said substrate except on said electron emission electrodes and their vicinity, a gate electrode formed on said insulating layer and having openings surrounding respective said electron emission electrodes, a first focusing electrode surrounding said gate electrode, and a second focusing electrode surrounding said first focusing electrode, at least one of said first and second focusing electrode being divided into at least four parts such that a pair of said focusing electrode parts face each other with said gate electrode between them so as to be controlled at the same time.

5. A cathode ray tube provided with a cold cathode comprising: a substrate, a plurality of electron emission electrodes formed on said substrate to provide a circular electron emission area having at least three parts, including a middle vertically long electron emission area, an insulating layer formed on said substrate except on said electron emission electrodes and their vicinity, and a gate electrode formed on said insulating layer and having openings surrounding respective said electron emission electrodes, wherein electrons are emitted from said circular electron emission area when a central part of the display screen is scanned and electrons are emitted from only said middle vertically long electron emission area when a peripheral part of the display screen is scanned, and thereby keeping total emitted current almost constant regardless of a scanning position on said display screen.

* * * * *